United States Patent [19]

Loquenz et al.

[11] Patent Number: 4,834,837

[45] Date of Patent: May 30, 1989

[54] METHOD FOR DELIGNIFICATION OF CELLULOSE WITH OXYGEN

[75] Inventors: Heinz Loquenz, Graz; Siegfried Meissl, Stallhofen; Helmut Schweiger, Graz; Norbert Meindl, Gmunden; Karl Schwarzl, Steyrermühl; Anton Hruschka, Vienna, all of Austria

[73] Assignees: Waagner-Biro Aktiengesellschaft; Steyrermuhl Papierfabriks-und-Verlags-Aktiengesellschaft, both of Austria

[21] Appl. No.: 76,383

[22] Filed: Jul. 22, 1987

Related U.S. Application Data

[63] Continuation of Ser. No. 748,434, Jun. 25, 1985, abandoned.

[30] Foreign Application Priority Data

Jun. 27, 1984 [AT] Austria ..... 2069/84

[51] Int. Cl.[4] ..... D21C 9/147; D21C 9/16

[52] U.S. Cl. ..... 162/19; 162/40; 162/56; 162/65; 162/78

[58] Field of Search ..... 162/40, 65, 78, 90, 162/60, 76, 37, 56, 18, 19, 250, 251, 57

[56] References Cited

U.S. PATENT DOCUMENTS

| | | | |
|---|---|---|---|
| 3,963,561 | 6/1976 | Richter | 162/65 |
| 4,177,105 | 12/1974 | Laakso et al. | 162/65 |
| 4,196,043 | 4/1980 | Singh | 162/78 |
| 4,259,150 | 3/1981 | Prough | 162/65 |
| 4,298,427 | 11/1981 | Bentvelzen et al. | 162/65 |
| 4,372,812 | 2/1983 | Phillips et al. | 162/65 |

OTHER PUBLICATIONS

Rydholm, "Pulping Processes", Interscience Publishers, N.Y., p. 336, Sep. 1967.

Fujii et al., "Oxygen Pulping of Hardwoods"; *TAPII*, Aug. 1978, vol. 61, No. 8, p. 37.

*Primary Examiner*—Steve Alvo

*Attorney, Agent, or Firm*—Steinberg & Raskin

[57] ABSTRACT

Method and apparatus for delignifying chemical pulp by means of oxygen, in which an aqueous slurry of chemical pulp is formed, then mixed with a caustic agent, followed by contact with a delignifying fluid. Water is drained off the slurry without reduction of pressure and while maintaining temperature following which the resulting slurry is maintained under these temperature and pressure conditions for a discrete period of time. The thus-obtained treated slurry is then washed.

17 Claims, 3 Drawing Sheets

METHOD FOR DELIGNIFICATION OF CELLULOSE WITH OXYGEN

This is a continuation of application Ser. No. 748,434, filed June 25, 1985, now abandoned.

BACKGROUND OF THE INVENTION

The present invention relates to a method for delignifying chemical pulp with oxygen and/or ozone, and with a possible peroxide additive. The present invention also relates to an apparatus for delignifying chemical pulp, as well as to a circulation system for executing the process of delignifying the chemical pulp.

Chemical pulp is commonly bleached with $O_2$ or $O_3$. Familiar processes either involve thick mass slurry bleaching with almost dry chemical pulp, or thin mass slurry bleaching of chemical pulp having a concentration of about 3% of dry substance. While thick mass slurry bleaching produces disadvantages in quality of chemical pulp, and thus makes it more difficult to execute the process, thin mass slurry bleaching has been uneconomical, due to required reactor size and required power consumption.

SUMMARY OF THE INVENTION

Accordingly, it is an object of the present invention to provide new and improved method and apparatus for delignification of cellulose pulp with oxygen.

It is also an object of the present invention to eliminate the above-noted disadvantages with respect to the prior art.

It is another object of the present invention to improve the quality of pulp that is produced during the delignifying process.

It is an additional object of the present invention to reduce required energy consumption during delignifying of chemical pulp.

It is a further object of the present invention to improve flow of chemical pulp during a continuous delignification thereof.

It is yet another object of the present invention to improve utilization of a delignifying fluid during the delignification of chemical pulp.

It is yet a further object of the present invention to reduce required delignification temperature and concomitant heat consumption during the delignification of chemical pulp.

It is even a further object of the present invention to reduce the overall size and capacity of the equipment required for delignifying pulp.

These and other objects are attained by the present invention which provides a method of delignifying chemical pulp by means of oxygen, in which a chemical pulp aqueous slurry is formed to contain about 2.5 to 4.5 percent of suspended solids. The thus-formed slurry is mixed with a caustic agent, and then contacted with oxygen at a temperature of about 80° to 150° C. Water is then drained off without reduction of pressure, and while maintaining the temperature, with the slurry then having a concentration of about 10 to 30 percent suspended solids. The resulting slurry is maintained at the pressure and temperature conditions for at least about 20 minutes, and then washed.

The present invention also provides an apparatus for delignifying pulp which comprises a pressure vessel, a central reaction zone formed within the pressure vessel, means for introducing delifnifying fluid into the central reaction zone, and means for dewatering pulp within the pressure vessel as the pulp enters the central reaction zone. Additionally, means for removing treated pulp from within the pressure vessel are provided.

The apparatus may also comprise means for introducing the pulp to be delignified into the pressure vessel and an outer annular zone surrounding the central reaction zone within the pressure vessel. Means for contacting the pulp introduced into the pressure vessel with the delignifying fluid introduced therein in the outer annular zone are provided, with the means for removing the treated pulp from within the pressure vessel communicating with the central reaction zone thereof.

A combined thin-medium mass slurry bleaching process is provided by the present invention which avoids the disadvantages of the prior art noted above. This is characterized by the fact that delignification occurs during one or several stages, while in the first stage or in a single stage, the chemical pulp, having been aqueously-suspended at a concentration of about 2.5 to 4.5 percent ATS (dry solids) and mixed with a caustic agent, is brought into contact with $O_2$ and possibly into contact with a peroxide additive in one or several reactors at a temperature of about 80° to 150° C.

Water is then drailed off while maintaining the pressure and temperature, with the treated slurry being maintained for at least 20 minutes at a concentration of about 10 to about 30 percent ATS (dry solids) within the same temperature and pressure range. The resulting slurry is then finally washed in a washing device, and, if necessary, fed to further stages for additional treatment.

Preferably, several delignification reactors, which are operated with varying, preferably increasing temperature and/or pressure in the direction of pulp flow are connected in series, with the chemical pulp being again diluted before entering a subsequent reactor.

The apparatus of the present invention is characterized by at least one pressure vessel for delignification. A dewatering device is provided in this pressure vessel which charges the slurried pulp from which water is to removed, into a distinct central reaction zone. Oxygen-containing gas is also charged into this central reaction zone and rises to the head chamber of the vessel in which a connection to a gassing device for the non-slurried pulp is provided. A draining screw is also provided so that the pulp may be transferred from within the pressure vessel to a further pressure and temperature treatment step.

Preferably, the gassing device includes a circulation system for the non-slurried pulp, including suction portions provided in the head chamber of the vessel, these ports termination in an outer annular channel of the pressure vessel that surrounds the central reaction zone. In the circulation system according to the present invention, several stages are provided for bleaching the chemical pulp, with the first stage provided for oxygen bleaching, and being connected, if necessary, to subsequent bleaching steps. Preferably, at least two subsequent stages are directed to bleaching the pulp with ozone as the bleaching agent, with a peroxide bleaching stage preferably being situated between the two subsequent ozone bleaching stages. A peroxide bleaching stage may also be conducted after the last ozone bleaching stage.

BRIEF DESCRIPTION OF THE DRAWINGS

The invention will be described in greater detail below, with reference to the accompanying drawings, in which.

DESCRIPTION OF THE PREFERRED EMBODIMENTS

Figure 1:
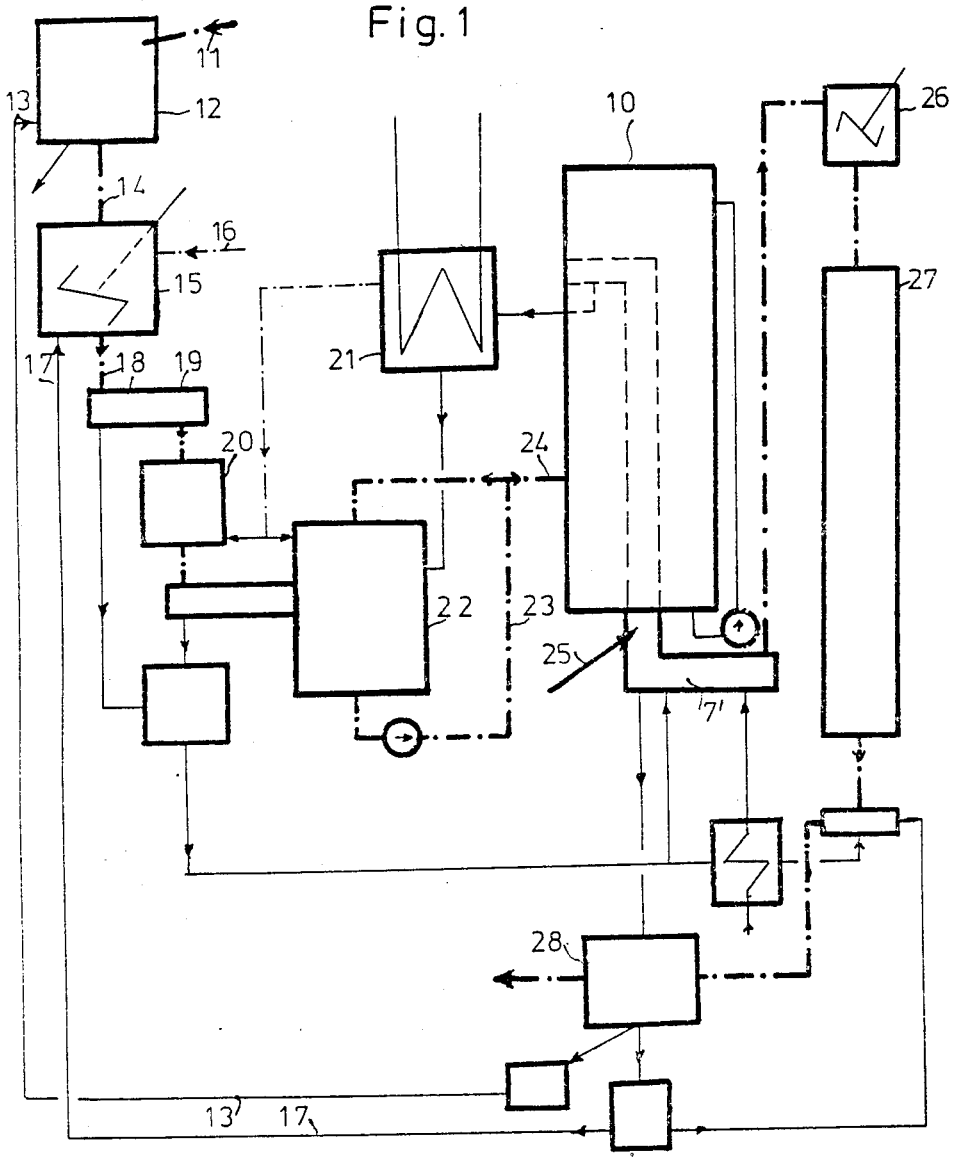
FIG. 1 is a schematic illustration of the overall process and apparatus according to the present invention.

Referring to FIG. 1, the chemical pulp to be delignified is filled according to arrow 11 in a washing filter 12 where the pulp is slightly heated to approximately 50° C. while water is admitted at approximately 70° C. from a pipe 13 into the washing filter 12. The heated pulp then reaches a processing container 15 through a pipe 14, where the heated pulp is mixed and agitated with a caustic agent such as NaOH or MgO, introduced into the container 15 according to arrow 16. Wash water heated to approximately 80° C. is fed through a pipe 17 and into the processing container 15, so that the pulp is heated to approximately 70° C. therein.

The processed chemical pulp is then fed through a pipe 18 to a draining device 19, such as a draining screw. The pulp is then fed with approximately 11 percent ATS concentration (dry solids concentration) to a preheating stage 20. In the preheating stage 20, the pulp is heated with saturated steam at about 140° C. temperature. The steam is produced by a saturated steam generator 21, which is in turn heated through heat exchange surfaces by means of turbine steam. This offers the advantge that the turbine steam does not become contaminated, and that any quantity of processing water which naturally is contaminated, can be reprocessed.

The chemical pulp which has been partially heated in the first preheater 20, again has water drained off therefrom, and is fed to a second preheater 22 which is heated with hot water at 140° C. supplied by the saturated steam generator 21. In order to more thoroughly mix chemical pulp, the pulp is recirculated several times through a pipe 23, while each time a partial current is fed through a pipe 24 to the actual delignification apparatus 10.

In the delignification apparatus 10, oxygen and/or ozone, possibly with a peroxide additive, is charged according to arrow 25 and brought into contact with the chemical pulp whereby actual delignification is begun. The delignified chemical pulp is discharged through drainage screw 7' and supplied through an agitator container 26 to a batch container 27, from which the pulp is drawn through a washing filter 28. The water resulting from the washing process, which principally flows through the drainage screw 7' is collected in two temperature stages and re-circulated through pipes 13 and 17. The advantage of this circulation system is that, due to the heat re-circulation as illustrated in FIG. 2, as well as the step-by-step increase in pressure in the individual reactors or vessels 1, 1', a large quantity of energy can be recovered with turbine steam being used only on the order of magnitude of about 9 metric tons/hour at a pressure level of about 8 bar while the accumulating condensate is returned to the boiler.

With this quantity of steam, at least 8 metric tons of chemical pulp can be bleached, while it is diluted in stages by the addition of water to obtain a concentration of about 3 percent of dry substance, whereby more than 400 metric tons of liquid per hour are passed through during some of the stages. This data is pertinent when using MgO as the caustic agent. When using NaOH as a caustic agent, heat consumption is even lower.

Figure 2:
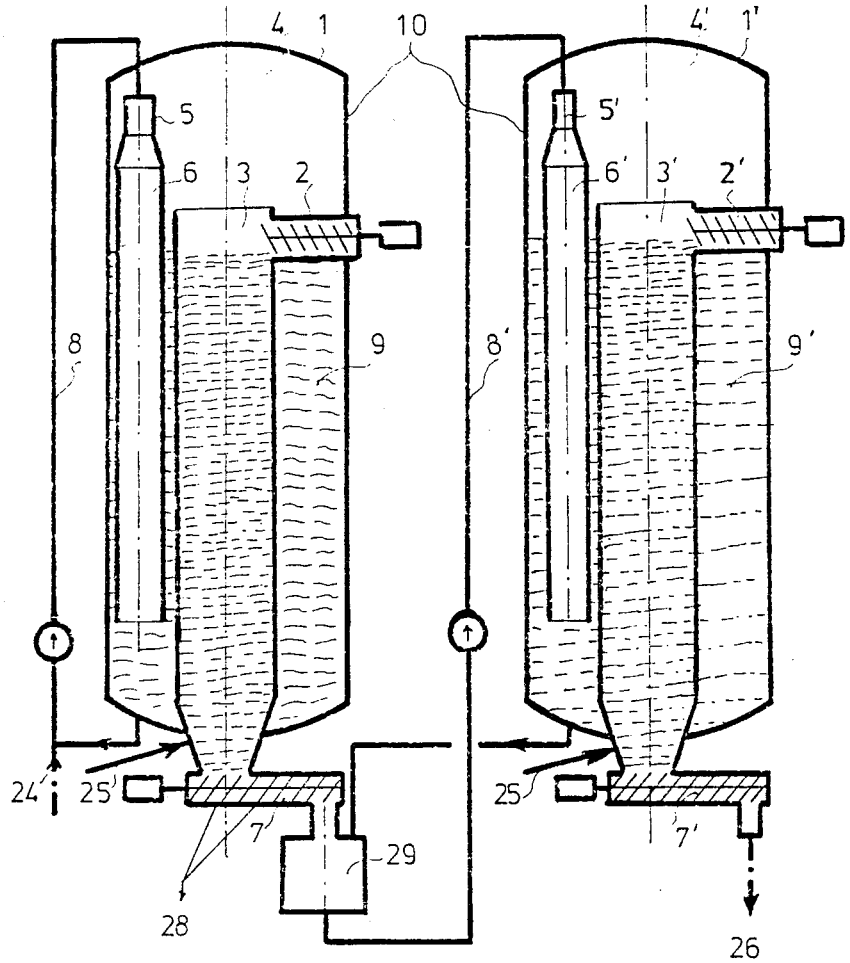
FIG. 2 is schematic illustration of the process and apparatus of the present invention in greater detail with delignification being conducted in two stages.

FIG. 2 illustrates the delignification apparatus 10 which is in the form of two vessels 1, 1', that are operated with varying pressures and temperatures. Chemical pulp is charged through the pipe 24 in the circulation system 8 of the pressure vessel 1. The circulation system 8 is provided with a connection 5 in a head chamber 4 of the vessel 1, in which gas accumulated within the head chamber 4 is drawn in and brought into contact in a gassing device 6, with the liquid chemical pulp having a concentration of about 3 percent ATS. Due to the intensity of the contact, delignification will continue after mechanical gassing has been completed, so that, in order to save space, the gassed chemical pulp is delivered through a dewatering device 2 or 2' to a central reaction zone 3 or 3'. In doing so, the forced out liquid is returned to an outer annular zone 9 of the vessel 1 (an outer annular zone 9' of the vessel 1') so as to prevent any loss of liquid.

The partially drained off chemical pulp now accumulates in the central reaction zone 3 or 3', where the carried oxygen continues to effect delignification, so that after a residence period of one-half to one hour, the chemical pulp, which has been drained off to approximately 12 to 15 percent ATS can be discharged at the lower end of the discharge zone through a further drainage screw 7 in vessel 1 of 7' in vessel 1'.

The drained off liquid flows from the drainage screw 7 of vessel 1 into a storage tank 28 from where it is recirculated. For practical purposes, the gas supply of oxygen and/or ozone to the head chamber 4 of vessel 1 is effected through the central reaction zone 3 so that the gas rises into the head chamber 4. Gas is similarly supplied into a head chamber 4' within the vessel 1'.

The chemical pulp discharged from the vessel 1 has a temperature of, for example, 120° C., with a pressure volume of approximately 4 bar being present in vessel 1. At the outlet of the drainage screw 7, the pulp enters the pressure system of the subsequent vessel 1', which operates at approximately 130° C. and 8 bar. Due to the draining process, only a relatively small quantity of water is admitted into the second vessel 1', thus negligibly reducing the temperature and pressure level within the second vessel 1'. This reduction can be balanced by an auxiliary heater, not illustrated. The chemical pulp discharged from the vessel 1 enters a suspension container 29, from where it is fed to the circulation pipe 8' for gassing at the higher temperature and pressure levels within the subsequent vessel 1'. Apart from the varying temperature and pressure levels, the vessels 1 and 1' are both similar in characteristics and construction. The discharge screw 7' from the second vessel 1' is also constructed in accordance with the same principles, however, this subsequent discharge screw 7' must be sealed against a greater pressure reduction from 8 to 0 bar.

It has been experimentally established in accordance with the present invention that a pulp suspension gassed with $O_2$ can be continuously delignified for a specified period of time, even after the mechanical gassing thereof has been completed, provided that the previous $O_2$ supply to the pulp fiber was sufficiently intensive. Tests with suspensions of approximately 2 to 3 percent suspended solids concentration, have shown that an after-reaction for more than one hour is possible to a degree that is technically feasible.

The reactor vessel used for reaction control, may be constituted by two zones which are interconnected by a dewatering device, and which operate at the same pressure or temperature. In other words, the preheated pulp suspension (thin mass slurried pulp with 2 to 3.5 percent dry solids concentration) is intensively circulated and gassed with $O_2$ in the outer annular zone 9, 9' of the reaction vessel 1, 1'. Delignification already takes place during this step. Subsequently, the pulp is thickened by means of a dewatering screw 2, 2' to approximately 10 to 15 percent dry solids concentration, and then conveyed to the control chamber 3, 3' where, by maintaining the same pressure and temperature, in particular an $O_2$ partial pressure, the after-reaction occurs.

Due to the extremely reduced volume of the suspension, which is fed to the central zone 3 or 3', the overall volume of the apparatus can be considerably reduced in comparison with a conventional thin mass slurry bleaching apparatus while both machines maintain similar retention periods.

The application of a combined thin-medium mass bleaching offers quite considerable advantages in terms of heating. The liquid drained off from the thin mass slurry pul, without being discharged with the pulp itself from the pressurized equipment, is used for preheating and diluting the newly-charged chemical pulp. The bleach flows from the screw troughs directly to the saturated steam generator 21 where part of the bleach is vaporized by the heat supplied by the low pressure steam. The steam produced in the saturated steam generator 21 serves to heat the fresh pulp in the preheater 22 to operating conditions, while the remaining and predominant part is used for diluting the pulp in the preheater 22. This, on the one hand, ensures uncontaminated operation of the heating surface located in the saturated steam generator 21 and, on the other hand, ensures even heating by pulp agitation (condensation of saturated steam) as well as ensuring trouble-free dilution of the pulp.

The heat contained in the condensate of this super heated live steam should not be considered a loss of heat, since the condensate remains pure and can thus be recirculated.

An important component, namely the charge screw between the preheater stage 20 and the preheater 22, has the function of charging and sealing the pulp between the pressurized and zero pressure equipment. Additionally, this screw drains the pulp that has been preheated with warm water or superheated steam in the first preheater stage 20. The filtrate of the second stage of the washing filter 18 is used as preheating liquid in the first stage with the filtrate being mixed in the processing container 15 with the pulp discharged from the washing filter 12. In order to maintain the preheating energy low and to not excessively burden the sealing screw wich is connected between the preheater stage 20 and the preheater 22, the pulp preheated in the processing container 15 is predrained. The drained off liquid is used for diluting the pulp before the pulp enters the washing filter 28.

Apart from the loss of insulation, the above-described system merely loses heat contained within the washing water of first washing filter 12 (filtrate of zone 1 from the washing filter 28), as well as the heat contained in the pulp discharged from the washing filter 28. The total heat with superheated steam at a maximum bleaching temperature of 130° C. that must be supplied to the system, is approximately $23.10^8$ joule/t or 550,000 kcal/t of dry substance.

The delignified pulp has a temperature of about 68° C. with an 11 percent dry solids content at the discharge end of the washing filter 28. The heat can be utilized accordingly in subsequent bleaching stages.

Figure 3:
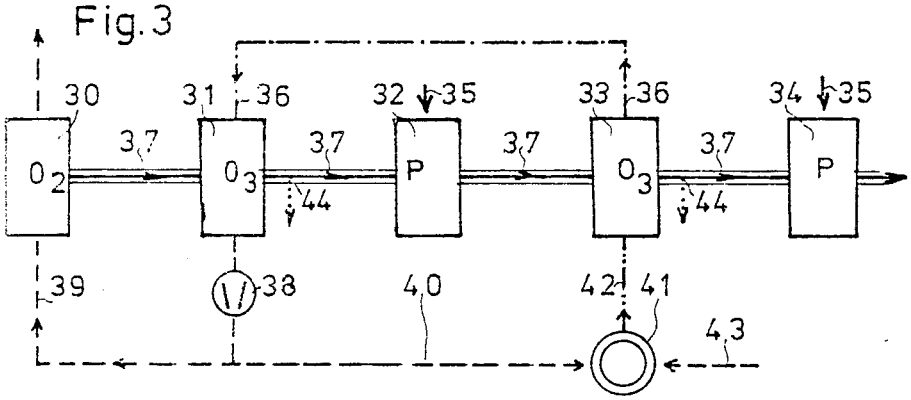
FIG. 3 is a schematic illustration of multistage delignification in accordance with the present invention.

FIG. 3 illustrates a circulation system in accordance with the present invention with several bleaching stages, where oxygen is used in the first stage 30. The first stage 30 primarily encompasses the thermal circulation system and equipment including the washing filter 28, illustrated in FIGS. 1 and 2. The washed chemical pulp is cooled in the pipe 37 to approximately 30° C., before entering the first ozone bleaching stage 31 which is operated at less than about 4 percent ATS concentration of the pulp suspension. After an alkaline extraction of the released lignin components at 44, the pulp suspension is fed to a peroxide bleaching stage 32, and subsequently to a second ozone-operated bleaching stage 33, to which a subsequent alkaline extraction stage 44 is connected. The thus treated slurry is then fed to a final bleaching stage with peroxide 34, with the peroxide supply designated by arrow 35 in FIG. 3.

Ozone generation takes place in an ozone generator 41, which is supplied with oxygen through pipes 40 and 43. An ozone-containing bleaaching gas which is generally oxygen/ozone mixture, is fed with approximately 10 percent ozone concentration to the second ozone bleaching stage 33 through pipe 42. The exhaust gas 36 containing approximately 5 percent zone is fed in counter-current to the chemical pulp of the first ozone bleaching stage 31. The resulting oxygen-containing residual gas with traces of ozone is fed through a pipe 39 to the oxygen bleaching stage 30. Excess oxygen is returned through pipe 40 to the ozone generator 41, with the pressure loss being compensated by a circulation blower 38. The bleaching gas is fed to the chemical pulp in either a counter-current or cross-current mode in the individual bleaching stages 30, 31, and 33.

The number of bleaching stages can be enlarged within the scope of the present invention, depending upon the degree of whiteness desired. Alternatively, the number of bleaching stages can be reduced, while the bleaching sequence is maintained, using, if necessary, ozone-peroxide or ozone-peroxide-ozone-peroxide. The alkaline extraction stage 44 is driven with a peroxide additive, and can therefore also be considered a bleaching stage. The alkaline extraction stage 44 may also possibly coincide with the bleaching stage 32. However, the alkaline extraction stage may also be replaced by an alkaline washing process at the washing filter that takes place at the end of the ozone stage 31.

The present invention offers the following overall advantages. In contrast to conventional thin-mass slurrying bleaching, the present invention considerably reduces the size of the equipment required, and also ensures quality pulp. Reduced energy consumption due to maximum insulation of the circulation system is provided by the present invention. A pumpable suspension in the pressurized equipment, especially between the preheaters and the actual reactors, as well as in the gassing component is also ensured by the present invention.

Intensive oxygen supply by gassing in the thin mass slurry zone of the reactor, is ensured by the present invention. Furthermore, the heat requirements are reduced by the present invention to approximately $15.10^8$ joule/t of dry substance when NaOH is used as the caustic agent and the maximum bleaching temperature is reduced to approximately 80°–100° C. This heat requirement will be compensated by the superheated steam.

The preceding description of the present invention is merely exemplary and is not intended to limit the scope thereof in any way.

What is claimed is:

1. Method of delignifying chemical pulp by means of oxygen, which comprises:

forming a chemical pulp aqueous slurry, mixing the thus-formed slurry with an aqueous caustic agent and preheating the resulting slurry to about 70° C., further heating the thus preheated slurry by indirect heat supply to about 140° C., contacting and mixing the resulting heated slurry in a first phase at a first concentration of about 2.5 to 4.5 percent of suspended solids and at a temperature of about 80° to 150° C. with oxygen, to effect oxygenation and thereby delignification of the pulp, draining off water from the resulting heated slurry of said first phase without reduction of pressure and while maintaining said temperature to provide a second phase wherein the slurry has a second concentration considerably exceeding said first concentration and amounting to about 10 to 30 percent of suspended solids, recycling part of said drained off water to said mixing and preheating stage, maintaining the resulting slurry under the above temperature, and second concentration conditions and without reduction of the pressure for at least about 20 minutes, and washing the thus-obtained, treated slurry.

2. The method of claim 1, and further comprising mixing the slurry with ozone after the washing in at least one subsequent stage in an acidified state and at a concentration below 4 percent of solid substance and at a temperature significantly lower than said temperature during the preceding contact with the oxygen.

3. The method of claim 2, wherein the ozone-containing bleach is directed into counter-current contact with the slurry during the ozone mixing with the slurry in excess and at low temperature, and waste gas thereof still containing $O_2/O_3$ is then directed into the next higher temperature stage and into contact with the slurry during the oxygen contact thereof.

4. The method of claim 2, and further comprising feeding oxygen-containing residual gaseous medium derived from the at least one subsequent stage to said oxygen-contacting step.

5. The method of claim 1, and further comprising washing the ozone-treated slurry after the mixing thereof with the ozone, and bleaching the thus-washed slurry with peroxide.

6. The method of claim 2, and further comprising alkaline extraction of the slurry following said subsequent stage.

7. The method of claim 2 wherein said significantly lower temperature is about 30° C.

8. The method of claim 1, and further comprising mixing the slurry after the washing in at least two subsequent stages with ozone, and treating the slurry between the subsequent stages, with peroxide.

9. The method of claim 8, wherein the mixing is performed with fresh ozone-containing medium during the later one of said subsequent stages and with exhaust medium derived from said later stage during the earlier of said subsequent stges.

10. The method of claim 1, wherein the water is drained off from the slurry after the first phase to provide a concentration of about 12 to 15% of suspended solids.

11. The method of claim 1, wherein maximum oxygenation temperature is about 100° C.

12. The method of claim 1, wherein the resulting preheated slurry is indirectly heated by saturated steam.

13. The method of claim 1, comprising the additional steps of after said washing step, mixing the slurry with ozone, washing the ozone-treated slurry after the mixing thereof with ozone, and then bleaching the thus-washed slurry with peroxide, and then bleaching the slurry with ozone a second time.

14. The method of claim 13, comprising the additional step of bleaching the slurry with peroxide a second time after the second ozone-bleaching step.

15. The method of claim 14, comprising the additional steps of carrying out an alkaline extraction of said slurry between said first ozone-bleaching and peroxide bleaching steps, and again between said second ozone-bleaching and peroxide bleaching steps.

16. The method of claim 1, comprising the additional steps of feeding the heated slurry to an outer annular zone of a reaction vessel where the slurry is mixed and contacted by the oxygen, then conveying the slurry to a dewatering screw wherein the water is drained off and into an outer central chamber of the vessel wherein the slurry is maintained for at least 20 minutes.

17. Method of delignifying chemical pulp by means of oxygen, which comprises:

forming a chemical pulp aqueous slurry, mixing the thus-formed slurry with a caustic agent, preheating the resulting slurry, contacting the resulting preheated slurry in a first phase at a first concentration of about 2.5 to 4.5 percent of suspended solids and at a temperature of about 80° to 150° C. and mixing the same with oxygen, to effect oxygenation and thereby delignification of the pulp, draining off water from the slurry of said first phase without reduction of pressure and while maintaining said temperature, to provide a second phase wherein the slurry has a second concentration considerably exceeding said first concentration and amounting to about 10 to 30 percent of suspended solids, maintaining the resulting slurry under the above temperature and second concentration conditions and without reduction of pressure for at least about 20 minutes, and washing the thus-obtained, treated slurry, wherein the pulp is pre-heated by the steps of first slightly heating the pulp to about 50° C. by mixing with water of about 70° C. prior to the mixing with the caustic agent, then heating the pulp to about 70° C. upon mixing with the caustic agent by introducing water at about 80° C., then preheating the resulting slurry indirectly by saturated steam at about 140° C. in a first stage, draining off water from the resulting pre-heated slurry, further heating the resulting slurry with hot water at about 140° C. in a second stage, and recycling part of the thus-further heated slurry back to said second stage, to thoroughly mix the pulp in the slurry.

* * * * *